United States Patent [19]

Namanny et al.

[11] Patent Number: 4,844,461

[45] Date of Patent: Jul. 4, 1989

[54] METHOD OF USING ROBOTS TO CONDUCT A COMPETITION

[76] Inventors: Keith E. Namanny; Kerry T. Namanny, both of 183 N. Main, Cumberland, Iowa 50843; Paul P. Bigelow, Rte. 1, Box 75, Bridgewater, Iowa 50837

[21] Appl. No.: 123,807

[22] Filed: Nov. 23, 1987

[51] Int. Cl.[4] ..... A63F 9/00

[52] U.S. Cl. ..... 273/85 R; 273/DIG. 19; 273/1 G; 273/85 F; 272/76; 272/1 D; 446/330; 446/334

[58] Field of Search ..... 273/1 R, 1 G, 1 GE, 273/1 GH, 1 GI, 85 R, 85 F, DIG. 19; 272/76, 1 D; 434/247, 256, 446/330, 334

[56] References Cited

U.S. PATENT DOCUMENTS

| | | | |
|---|---|---|---|
| 1,736,163 | 11/1929 | McGee | 446/334 |
| 1,745,434 | 2/1930 | McIntosh | 446/334 |
| 2,235,259 | 3/1941 | Glass | 273/85 F |
| 2,538,744 | 1/1951 | Berry | 446/335 |
| 2,909,370 | 10/1959 | Fortney | 272/76 |
| 3,250,533 | 5/1966 | Nicholson | 272/76 |
| 3,845,956 | 11/1974 | Goldfarb et al. | 273/85 F |

*Primary Examiner*—Leo P. Picard
*Assistant Examiner*—Jessica J. Harrison
*Attorney, Agent, or Firm*—James D. Welch

[57] ABSTRACT

Life size figures are disclosed which game participants can strap themselves to, for the purpose of having a boxing match, via the figures. The figures have heads which can rotate up and back, arms which can be caused to throw punches, and bodies with rollers on the bottom. A game participant straps him or herself to the figure at his or her waist, so that when he or she moves forward, backward or to either side, the figure also moves in the same manner. The figures also have handles extending from their back side, which game participants can grab with their hands, and push on to cause the figure's arms to throw upper-cut and hook etc. punches. When a punch lands on the opponent figure's head, the head rotates up and back and a point is scored. If a very good punch is landed, the head stays back and a knock-out is scored. The figures normally sit atop a table which is decorated to resemble a boxing ring, and electrical contacts in the head can be used to detect scored points and prompt a scoreboard to register a score.

1 Claim, 1 Drawing Sheet

METHOD OF USING ROBOTS TO CONDUCT A COMPETITION

TECHNICAL FIELD

This invention relates to figures for use in games and more particularly to life size figures which game participants actually become attached to during a competition.

BACKGROUND

Many patents have issued for toy figures, such as robots, which are incorporated into game apparatus in a fashion such that motion can be imparted to the figures by participants in a game. For instance, toy boxing figures are taught in U.S. Pat. Nos. 2,235,259 to Glass et. al., and 2,538,744 to Berry and 1,736,163 to McGee. Life size figures for use by boxers in sparing practise are also taught in U.S. Pat. Nos. 2,909,370 to Fortney and 3,250,533 to Nicholson.

The inventions taught in the indicated patents provide for toys in which a game participant can control the movement of small figures; and for life size figures with which one can spar, but which life size figures perform actions which are not under direct control by the participant. No reference of which the applicant is aware, however, teaches a life size figure which a participant can control the actions of, by direct involvement. A need exists for life size figures which game participants can become "attached to" in a fashion such that they can directly control the actions of the figures by their bodily actions and thereby cause multiple such figures to interact with one another in accordance with game rules of interaction.

DISCLOSURE OF THE INVENTION

In 1986, Mr. Keith E. Namanny conceived and reduced to practice life-size robots, measuring approximately 42 inches high and 14 inches square. The robots have rollers on the bottom, and apparatus extending from their back side which allow game players to be strapped to the robot at their waist, via a rod which attaches to the robot base. The robot is designed to sit atop a table, which table is normally approximately 36 inches high. The game player can, by moving his or her body forward or backward, or to either side, cause the robot to move in a similar manner on the top of the table. Also extending from the back side of the robot are handles which a game player can grasp in his hands. There are two such handles and each controls the motion of one of two arms on the robot. Because the game player is strapped to the robot, leverage can be developed by the game player and by pushing on the handles it is possible to cause the robot's arms to throw "uppercuts" and "hook" type punches. The arms are attached to the robot body in a fashion allowing rotational motion. Also, a counter weight is incorporated to cause a robot's arm to resume a neutral position unless caused to do otherwise by a game player. Mr. Namanny uses the robots, as described, in a game in which two such robots box with each other direct control of two game players, each of which is strapped to one robot. The head of each robot is mounted in a fashion allowing it to rotate up and back when a punch is landed. Mr. Namanny provides that a point is scored each time a robot's head is caused to move up and back by a punch landed by the opponent robot. If a robot's head is hit very hard it stays up and back, and a knock-out is scored.

It will be appreciated that a game participant becomes physically a part of the robot by being strapped to it, and because of the firm attachment of a game player to a robot, it is possible for the game player to cause the robot to throw punches by operation of handles which are connected to the robot's arms. A game participant can also cause a robot to move forward, backward, and to both sides on the table upon which the robot is setting, by a similar motion of his or her body. Also of interest is that the table is usually constructed to resemble a boxing ring.

Mr. Kerry T. Namanny and Mr. Paul P. Bigelow aided Mr. Keith E. Namanny with the final reduction to practise of the invention.

DETAILED DESCRIPTION

Figure 1:
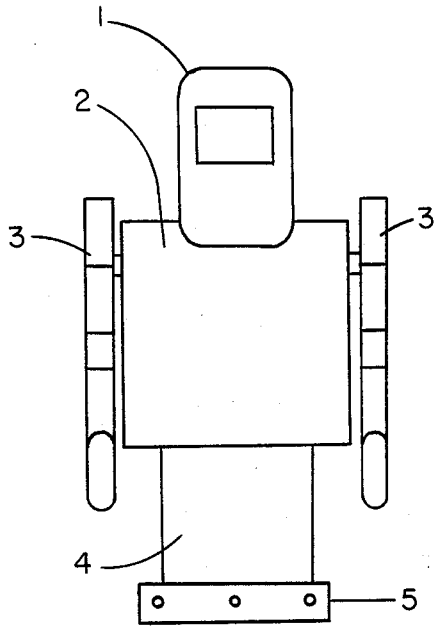
FIG. 1 shows a front elevational view of a Robot.
Figure 2:
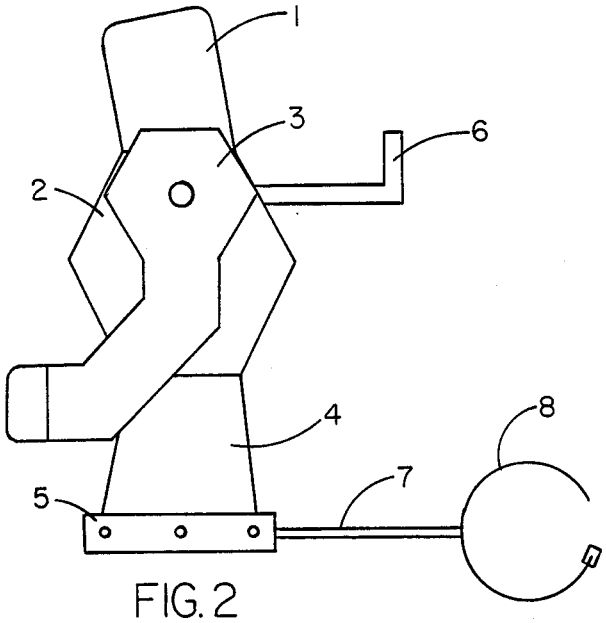
FIG. 2 shows a side elevational view of a Robot.
Figure 5:
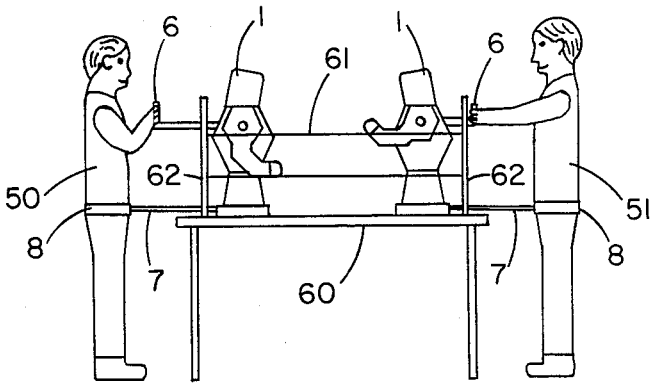
FIG. 5 shows a table constructed to resemble a ring, with two game participants, each shown strapped to a Robot and engaging in a competition.

Turning now to FIG. 1, it is shown that the Robot is comprised of a head (1), a body (2), a lower body (4), a base (5) and arms (3). FIG. 2 further shows handles (6) and an extension rod (7) with participant strap (8). FIG. 5 shows a participant uses the strap (8) to attach the robot his or her waist via the extension rod (7), which extension rod attaches to the robot's base (5). FIG. 5 also shows that a participant grabs onto the handles (6) and uses them to cause the arms (3) of the robot to punch at another robot. The arms are attached to the robot's body (2) by means of linkage (not shown) which allows rotational motion. As a result "upper-cut" and "hook" etc. type punches can be thrown under the control of a participant. When a handle is pushed forward an upper-cut punch is thrown, and when the handles are pushed to the side and forward, a hook-like punch is thrown. Note that it is only because the participant is strapped to the robot that leverage can be developed allowing punches to be thrown by a robot. If the participant were not straped to the robot, pushing on the handles would simply cause the robot to move as a whole. Also present, (not shown), in the arm linkage is a counter weight which serves to return the robot arm to a neutral position when not pushed upon by a participant.

During use, two robots are placed upon a table, which table can be constructed to resemble a boxing ring by addition of ropes (61) and ring posts (62). See FIG. 5.

Figure 3:
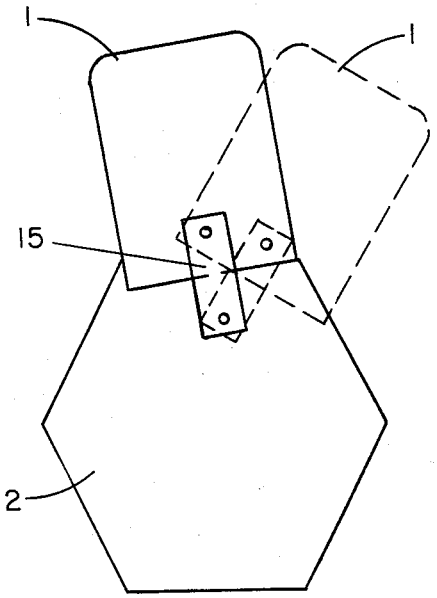
FIG. 3 shows a cross sectional evational side view of the head of a Robot, with indication of its ability to rotate up and back.

FIG. 3 shows that the robot's head (1) is attached to the robot's body (2) by means (15) which allow it to rotate up and back when hit. Also note that if a very good punch is landed, the head can rotate up and back and remain there, which action constitutes a "knock-out". Points are scored by causing the robot's head (1) to rotate up and back. Electrical contacts, (not shown), monitor the head motion and can be used to control a score board (not shown).

Figure 4:
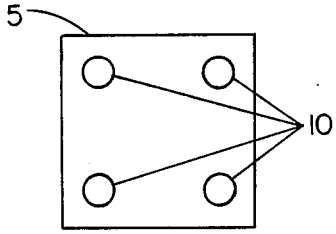
FIG. 4 shows a bottom view of a Robot, and indicates the presence of rollers.

FIG. 4 shows that there are rollers (10) on the bottom of the robot's base (5). When a participant moves his or her body forward or backward, or to either side, the motion is imparted to the robot via participant strap (8) and extension rod (7). The rollers (10) allow the motion to be easily imparted.

Having hereby disclosed the subject matter of this invention, it should be obvious that many modifications and substitutions and variations of the present invention are possible in light of the teachings. It is therefore to be understood that the invention may be practised other than as specifically described, and should be limited in breadth and scope only by the claims.

I claim:

1. A method of conducting a competition, which method of conducting a competition involves the user of two life size robots, which life size robots each comprise a head, body and arms; means for interconnecting the robot bodies and arms so that the arms can rotate at their point of attachment; means for interconnecting the robot bodies and heads so that the heads can rotate up and back at their point of attachment, as viewed from the side of the robots, and which robots each have an extension rod attached to the back thereof, to which extension rod is attached a strap, which strap is designed to attach to a participant's waist during competition so as to secure the robot to the participant and allow a participant's bodily movements to be directly imparted to the robot; which life size robots additionally have rollers on the bottom thereof; and which life size robots have handles extending from the back thereof onto which handles participants can grab and impart a force thereto, which force causes the robot's arms to rotate at their point of attachment to the robot's body and, in effect, throw punchs at the other robot which is positioned in front thereof, and which force is simultanously possible at both arms only because the participants are attached to the robots at their waist by means of the extension rod and strap; which competition comprises:

obtaining a table, which table can resemble a boxing ring;

placing two life size robots on the table;

attaching a participant to each robot, at each participant's waist, by means of the extension rod and strap;

directing the participants to cause the robots to move on the table by moving their bodies forward, backward and to each side, while at the same time causing the robots to punch at each other with one or both arms simultanously by imparting force to the handles which extend from the backs of the robots; and scoring points to a participant when the other participant's robot's head is caused to rotate up and back, as viewed from the side of the robot, as a result of a punch by the participant's robot.

* * * * *